United States Patent [19]

Penne

[11] Patent Number: 4,461,494

[45] Date of Patent: Jul. 24, 1984

[54] PRESSURE SENSITIVE CARBONLESS COPYING SYSTEMS

[75] Inventor: Roger A. Penne, Beerzel, Belgium

[73] Assignee: Standard Oil Company (Indiana), Chicago, Ill.

[21] Appl. No.: 269,436

[22] Filed: Jun. 2, 1981

[30] Foreign Application Priority Data

Jun. 5, 1980 [BE] Belgium ..... 200.897

[51] Int. Cl.[3] ..... B41M 5/22

[52] U.S. Cl. ..... 346/211; 428/328; 428/331; 428/452; 428/453; 428/454; 346/219; 346/225

[58] Field of Search ..... 282/27.5; 427/150, 151; 428/320.4, 320.6, 320.8, 452–454, 537, 913, 914, 411, 328, 329, 331

[56] References Cited

FOREIGN PATENT DOCUMENTS 48-57706 8/1973 Japan ..... 282/27.5

49-19914 2/1974 Japan ..... 282/27.5

*Primary Examiner*—Bruce H. Hess

*Attorney, Agent, or Firm*—William E. Murray; William T. McClain; William H. Magidson

[57] ABSTRACT

This invention relates to sheet materials, on which a coating is applied and which are used for pressure sensitive carbonless copying systems, wherein at least one of the components responsible for color development in the coating is a predominantly white four layer structured lamelar ground chlorite mineral having an iron content of about 0.5% to 8% by weight preferably of about 3% by weight.

The components responsible for color development in the coating are preferably composed by 40 to 60% by weight of said ground chlorite mineral and 60 to 40% by weight of activated montmorillonite or bentonite or smectite clay.

4 Claims, No Drawings

PRESSURE SENSITIVE CARBONLESS COPYING SYSTEMS

PRIOR ART

Pressure sensitive copying systems with coated sheets are generally known. They are made-up from at least two coated sheets of paper referred to individually as the back coated sheet (CB) and the front coated sheet (CF). A number of front and back coated sheets (CF sheets) can be inserted between a CB sheet and a CF sheet. The CB sheets are coated with a substance containing tiny gelatine microcapsules in which a colourless leuco dyestuff is encapsulated. Such dyestuffs are capable of developing a colour when in contact with an electron accepting substrate. CF sheets are coated with an emulsion type paper coating containing such an electron accepting material.

When a CB sheet is put into contact with a CF sheet and pressure from a pencil or a typewriter key is exerted onto the CB sheet, it ruptures the capsules, releasing the leuco dyestuff which reacts with the CF coating to produce an image. The invention relates to an improvement in performance of the CF coating.

Primary requirements for such coatings are that the accepting layer is capable to develop a deep colour, maintaining this colour for a prolonged period of time if exposed to daylight and also in the absence of light. Colour formation should also not be too sensitive to changes in pH of the coating. On the other side, it is also important that the coating can be applied by usual coating techniques used in the paper coating industry. Low viscosity at high shear rates and near-Newtonian flow characteristics are very desirable.

High solids content of the coating is also advisable in order to obtain the necessary coating thickness, the minimum drying time and to minimize the energy required for evaporation. Important is also that the resulting coated paper maintains its original colour (f.i.white). It should not discolour to gray or yellow neither under the influence, nor in the absence of daylight.

A high surface smoothness of the coating is also required, with absence of any hard and abrasive material in order to prevent premature rupture of the capsules when several sheets are stacked on top of each other.

The sheet having the colour developing layer on its surface is prepared by applying to the base paper sheet a coating of following composition: a specific colour developing agent, one or several extenders and a water dilutable organic binder of the emulsion type with possibly some additives, such as wetting agents, antifoamers, thickeners, colorants, etc. The diluent is water.

The specific colour developing materials which are used today as reactive substrates for leuco dyestuffs are activated montmorillonite clays, activated bentonites and activated smectites. These techniques are described in many patents such as U.S. Pat. Nos. 2,464,127, 2,981,697, 3,293,060, 3,622,361, 3,622,364, 3,957,527 and 3,993,500, British Pat. Nos. 1,232,208 and 1,307,319, and Dutch published patent application No. 7,213,486.

The mentioned well known colour developing materials show some definite practical disadvantages. Activated montmorillonites, bentonites and smectites have very high water absorption characteristics together with excessively high viscosity and pseudo-plastic flow behaviour in aqueous media. They also cause an excessive yellowing of coating compositions containing the usual styrene-butadiene emulsion binders, this yellowing increasing by lowering the pH. They also show high abrasion values and cause undesirable surface roughness with an adverse effect on printability.

The problems associated with the use of activated montmorillonites, bentonites and smectites can be overcome partly by addition of 20 to 40% China clays (kaolins) with low water absorption which improve the rheological properties of the coating and/or smaller amounts of platy talcs which improve the surface smoothness, but which do not improve the rheology of the coating to the same extent as China clay.

China clays (kaolins) on the other hand have only poor influence on the colour development and are inferior in brightness and colour stability of the coating. Pure platy talcs in comparison with China clays show somewhat better but still insufficient reactivity with the leuco dyestuffs.

GENERAL DESCRIPTION OF THE INVENTION

This invention relates to a material in the form of a sheet on which a colour developing coating is applied and which is used in pressure sensitive carbonless copying systems.

The invention relates more specifically to a new composition of the colour developing substances of these sheets.

Applicant has discovered that certain pure non modified chlorites have very interesting colour developing properties when in contact with leuco dyestuffs, together with very interesting influences on the rheology of coating compositions and on the surface smoothness of the applied coatings.

This invention concerns specifically sheet materials on which a coating is applied, which is used for pressure sensitive carbonless copying systems and wherein at least one of the components responsible for colour development is a predominantly white pure ground four layer structured lamelar chlorite with an iron content, calculated as $Fe_2O_3$ of about 0.5% to 8% by weight, the iron content of said chlorite being preferably of about 3% by weight.

According to a feature of the invention, the above defined chlorite mineral is used as a dry ground product without any chemical or thermal post-treatment.

According to a preferred embodiment of the invention, the above defined chlorite is combined in the concerned copying sheets with other colour developing substances such as activated montmorillonite clays and/or activated bentonites and/or activated smectites.

According to a preferred embodiment of the invention, the filler composition responsible for colour development is composed by 40 to 60 percent by weight of the mentioned chlorite and by 60 to 40 procent by weight of activated montmorillonite or bentonite or smectite clay.

According to another feature of the invention, the "Hegeman" fineness of the ground chlorite is between 5 and 8, preferably between 5.5 and 6.5.

The invention relates also to coating compositions for the manufacture of a carbonless copy-sheet provided with a colour developing coating, in which a predominantly white non treated chlorite of the above defined type is used. As already mentioned, the chlorite included in these compositions belongs to the group of non expandable four layer structured chlorite minerals with an iron content of about 0.5 to 8% by weight, preferably about 3% by weight.

Particularly suitable coating compositions according to this invention are styrene-butadiene emulsion coatings with a pigment volume concentration of 70 to 80% and a solid content around 50%, 40 to 60 procent by weight of the total pigmentation being the mentioned chlorite of the above defined type.

Other features of the invention will appear from the following description of a number of analysis, mineral specifications and coating compositions which are applied in accordance with the invention. It is clear that these analysis, tests and examples are only given as illustration of the invention and are in no way a limitation of the general scope of the invention.

EXAMPLES

EXAMPLE I—Example of a particularly suitable mineral in accordance with the invention It has been stated that the chlorites of the type mined in the state Montana by Cyprus Industrial Minerals Corp, called Cyprus chlorites for convenience reasons, have such a degree of purity and such chemical compsition that their use in the colour developing coatings, in accordance with the invention, is very suitable.

Cyprus chlorites have the following chemical composition:

| | |
|---|---|
| MgO | ±32% |
| $SiO_2$ | ±32% |
| $Al_2O_3$ | ±20% |
| $Fe_2O_3$ | ±3% |
| $H_2O$ (combined) | ±12% |
| CaO | trace |
| $TiO_2$ | trace |

They can be characterized roughly by a general chemical formula of the type:

$$5MgO.(1-x)Al_2O_3.xFe_2O_3.3SiO_2.4H_2O;$$

x having a value of ±0.1

Cyprus chlorites have a high degree of brightness, a platy morphology and a very high purity. In comparison with ground talcs, Cyprus chlorites show a very low oil absorption and very low viscosities in water slurries. The surface of Cyprus chlorites is hydrophyllic and in the micronized state they are easily wetted and dispersed in water, with a minimum of anionic dispersing agent.

The pH of the suspension is a slightly alcaline; pH=±8.4 at a dilution in water of 1:5.

EXAMPLE II—Properties of Cyprus chlorites in CF coatings

(a) Reactivity with CB leuco dyestuffs

The reactivity of Cyprus chlorites (magnesium-aluminium silicates) with leuco dyestuffs is much higher than reactivity of usual China clays (aluminium silicates) and talcs (magnesium silicates), but lower than activated montmorillonite, bentonite and smectite clays.

The following table 1 shows intensity of developed colour with Cyprus chlorites in comparison with China clay (kaolin), talc and activated montmorillonite clay, in a coating composition based on a styrene-butadiene emulsion with a pH of 8.8 and a pigment volume concentration of 70%.

TABLE 1

| | % colour developed with respect to activated montmorillonite clay (=100) |
|---|---|
| Activated montmorillonite clay | 100% |
| Cyprus chlorite | 60% |
| Pure talc | 30% |
| China clay (kaolin) | 10% |
| Mixture of 7 parts by weight of activated montmorillonite clay and 3 parts by weight of kaolin | 75% |
| mixture of 4 parts by weight of activated montmorillonite clay and 6 parts by weight of Cyprus chlorite | 75% |

(b) Stability of the developed colour

The colour stability after 6 weeks daylight exposure is totally comparable with the stability shown by activated montmorillonite clay. After these 6 weeks exposure period, colour developed by normal coating clay (China clay) disappeared completely.

(c) pH independence

Any increase in pH has no influence on the stability of the colour developed in case of Cyprus chlorites.

(d) Colour stability of the coating (yellowing)

No noticeable yellowing is stated after a prolonged daylight exposure period of 6 weeks with Cyprus chlorites. Similar remark for exposure in the absence of light.

No pH dependency has been stated here also. Pure activated montmorillonite clay showed excessive yellowing at lower pH, improving at increasing pH values. Pure China clay showed intermediate yellowing.

(e) Rheological properties

Coating compositions with Cyprus chlorites show very low viscosities at high shear rates and very little pseudo-plasticity. Rheology is comparable to the rheology of fine China clays which are used as extender in coating compositions with activated montmorillonite clays in order to obtain acceptable rheology.

(f) Surface smoothness

Surface smoothness of coatings with Cyprus chlorites is comparable to the ideal surface smoothness given by fine platy talcs which are added to coating compositions with activated montmorillonite clays as additives to obtain acceptable surface smoothness, with regard to smudge resistance and printability.

EXAMPLE III—Comparison between various coating compositions containing Cyprus chlorites, activated montmorillonite clay and China clay Three different coating compositions of the styrene-butadiene type have been prepared, each of them at a pigment volume concentration of 70% and a total solid content of 50% by weight.

In composition A, the activated montmorillonite clay represents 70% and China clay (kaolin) 30% of the total pigmentation (% by weight).

In composition B, the activated montmorillonite clay represents 50% and Cyprus chlorite the remaining 50% of total pigmentation.

In composition C, the activated montmorillonite clay represents 40% and Cyprus chlorite 60% of the total pigmentation.

The measured pH values and low shear viscosities (Brookfield 20 rpm) are given in following table 2 for each of the coating compositions A, B and C.

The same coating compositions have been prepared afterwards at equal solid content, but at increased pH value of 9.5 for each composition by NaOH addition; in this way coatings D, E and F were obtained.

Composition D is identical to composition A but has a pH=9.5.

Composition E is identical to composition B but has a pH=9.5.

Composition F is identical to composition C but has a pH=9.5.

Compositions A, B, C, D, E and F have been coated on paper sheets and the following properties of the copying sheets have been tested:

intensity of the developed colour
light stability of the developed colour
yellowing characteristics of the copying sheets.

The results are given in the following table 2.

TABLE 2

| | Viscosity at low shear rate (Brookfield 20 rpm) | pH | Colour intensity after 6 weeks daylight exposure | Yellowing of the coating after 6 weeks daylight exposure |
|---|---|---|---|---|
| Composition A: 70% activated montmorillonite clay 30% China clay | 48 poise | 3.3 | good | strong |
| Composition B: 50% activated montmorillonite clay 50% Cyprus chlorite | 12 poise | 4.7 | better | slight |
| Composition C: 40% activated montmorillonite clay 60% Cyprus chlorite | 7 poise | 5.8 | good | slight-less than B |
| Composition D: Composition A with NaOH addition | 13 poise | 9.5 | very good | considerable but lower than A |
| Composition E: Composition B with NaOH addition | 6 poise | 9.5 | best | slight - less than B and C |
| Composition F: Composition C with NaOH addition | 1 poise | 9.5 | very good | minimum |

What I claim is:

1. A sheet material on which a coating is applied and which is used for pressure-sensitive carbonless copying systems, in which the components responsible for colour development in the coating consist essentially of a mixture of (1) a predominantly white four-layer structured lamelar chlorite mineral which has been dry ground without any chemical or thermal treatment and (2) an activated montmorillonite clay, bentonite clay or smectite clay.

2. A sheet material according to claim 1, in which the iron content of the chlorite mineral is about 0.5% to 8% by weight.

3. The sheet material of claim 1, in which the components responsible for colour development are composed by 40 to 60% by weight of said ground chlorite and 60 to 40% by weight of activated montmorillonite or bentonite or smectite clay.

4. The sheet material of claim 1, in which said ground chlorite has a Hegeman fineness between 5 and 8.

* * * * *